United States Patent [19]

Miyakawa et al.

[11] 4,423,134

[45] Dec. 27, 1983

[54] DEVELOPING UNIT FOR ELECTROPHOTOGRAPHY

[75] Inventors: Seiichi Miyakawa, Nagareyama; Akira Midorikawa, Yokohama; Kenzo Ariyama, Tokyo; Susumu Tatsumi, Kawasaki, all of Japan

[73] Assignee: Ricoh Company, Ltd., Japan

[21] Appl. No.: 878,749

[22] Filed: Feb. 17, 1978

Related U.S. Application Data

[63] Continuation of Ser. No. 630,519, Nov. 10, 1975, abandoned.

[30] Foreign Application Priority Data

Nov. 12, 1974 [JP] Japan ..... 49-130156
Dec. 24, 1974 [JP] Japan ..... 49-3294

[51] Int. Cl.[3] ..... G03G 9/04

[52] U.S. Cl. ..... 430/103; 118/647; 355/3 R

[58] Field of Search ..... 355/3 R, 3 CH, 10; 317/4, 262 A; 250/324–326; 118/647, 659, 648, 649, 650; 430/103; 361/225

[56] References Cited

U.S. PATENT DOCUMENTS 3,699,388 10/1972 Ukai ..... 317/4
3,752,119 8/1973 Matkan .
3,892,481 7/1975 Schaefer et al. ..... 355/10
3,936,184 2/1976 Tanaka et al. ..... 317/4
3,981,267 9/1976 Gardener et al. ..... 355/10 X
4,052,127 10/1977 Kuroishi et al. ..... 118/648 X

*Primary Examiner*—John P. McIntosh
*Attorney, Agent, or Firm*—Guy W. Shoup; Gerard F. Dunne

[57] ABSTRACT

A developing unit for use with an electrophotographic copying apparatus of the type comprising a developing electrode and at least one corona discharger includes a conductive member arranged within a shield casing of the discharger for obtaining a voltage to be applied to the developing electrode as a bias voltage thereto. In the case where an a.c. discharger for charge elimination is being used in addition to the primary discharger, conductive members are incorporated with respective dischargers and the outputs from the conductive members are superimposed on each other and applied to the developing electrode. In this instance, the output of the conductive member associated with the a.c. discharger is continuously applied to the developing electrode after the de-energization of the primary discharger, i.e., the completion of developing an electrostatic latent image to thereby prevent the deposition of toner on the developing electrode.

16 Claims, 14 Drawing Figures

DEVELOPING UNIT FOR ELECTROPHOTOGRAPHY

BACKGROUND OF THE INVENTION

This application is a continuation of application Ser. No. 630,519 filed Nov. 10, 1975, now abandoned.

The invention relates to a developing unit for an electrophotographic copying machine.

In known developing units for electrophotographic copying machines a developer is brought into contact with an electrostatic latent image to apply a toner thereto. Often, a developing electrode is disposed in spaced relationship with the photoresponsive surface on which the latent image is formed so as to prevent an edge effect and also to prevent the deposition of the toner onto the background of the image, in order to assure a high image quality. Usually, a predetermined bias voltage is applied to this developing electrode for providing the above-mentioned controlling functions. A number of techniques are available for applying the bias potential to the developing electrode, including a floating electrode technique wherein a potential is induced on the floating electrode by the charge of the latent image, and a forced bias technique wherein an external potential source is used.

In the former, namely, the floating electrode technique, while the arrangement is relatively simple, the background potential, that is the potential in the non-image portion of the latent image, is not completely zero volts, but there remains some residual potential. With an object being copied which has a reduced image area, the presence of the residual potential often causes a deposition of toner onto the non-image area, causing a so-called background smearing. Additionally, in the course of the developing process, and in prticular, in the course of a wet developing process, the toner contained in a developing solution may be deposited on the developing electrode to cause a similar background smearing in the non-image area, independently from the object being copied. The above applies also to the forced biased technique.

In the latter technique, which utilizes an external potential source, it is necessary to provide a separate bias supply. In particular, where a bias potential on the order of several hundred volts is employed, a number of components must be provided, including a transformer, rectifier, capacitor, dummy resistor, Zener diode or the like. When these components are incorporated into an electrophotographic copying machine, increased in the costs an as well as an increase in the overall size of the machine results.

Therefore, it is an object of the present invention to provide a developing unit which overcomes the above disadvantages, by providing a simple conductive member in association with a corona discharger located within the electrophotographic machine, the conductive member being supplied with a portion of an ionic current or charged particles generated by the electrode of the corona discharger so as to supply a bias voltage to a developing electrode.

It is another object of the present invention to provide a developing unit which prevents deposition of toner onto a developing electrode by utilizing an electromotive force which is developed by a corona discharger.

DETAILED DESCRIPTION OF EMBODIMENTS

Figure 1:
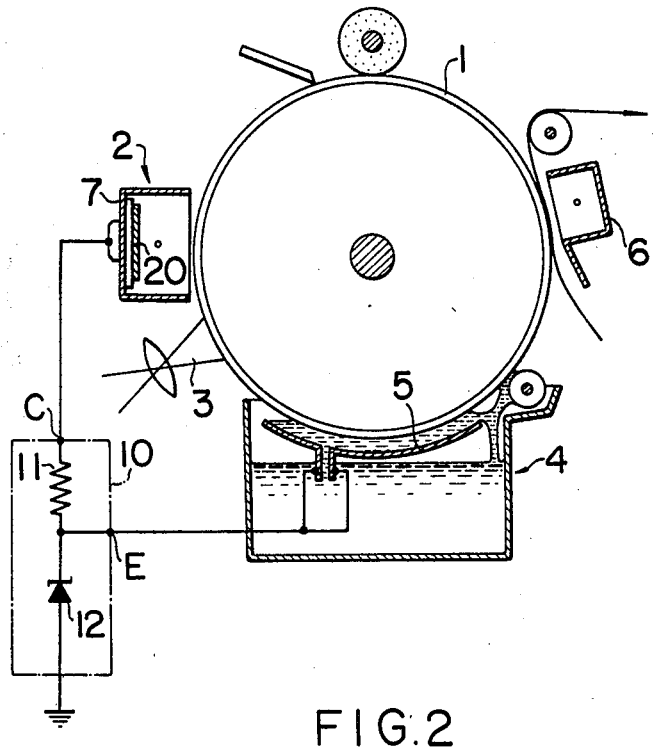
FIG. 1 is a schematic view of a copying machine incorporating a bias supply to the developing unit, according to the invention.

Referring to FIG. 1, there is shown an electrophotographic copying machine of a wet type including a photosensitive member formed of a photoconductive material such as selenium. The photosensitive member 1 is initially charged by a corona discharger 2 of a known construction and is then exposed to a light image of a document to be copied by an optical system 3 to form an electrostatic latent image on the peripheral surface of the photosensitive member 1. The latent image formed is converted into a toner image in a wet developing unit 4, which includes a developing electrode 5 in the form of a conductive member. The developing electrode also serves as a tray for carrying a quantity of the developing solution. An excess amount of developer is removed by a squeeze roller. Subsequently, the toner image is transferred onto a record paper by means of a transfer corona discharger 6. After the transfer, the photosensitive member 1, which may contain a slight amount of remaining developer, is cleaned by a cleaning roller and a cleaning blade in preparation for the next charging step.

In the example shown, the developing electrode 5 of the developing unit 4 is of a forced bias type and is supplied with a constant potential of, say +100 volts, which is of a magnitude equal to and a polarity the same as the potential to which the photosensitive member 1 is charged. Specifically, one end of the electrode 5 is connected to an output terminal E of a power supply circuit 10 which also includes a supply terminal C. If the power supply circuit 10 is absent, the terminal E would be directly connected with the terminal C which would be connected to a conductive member 20 located inside the corona discharger 2. In this way, corona ions or charged particles generated within the corona discharger 2 can be conducted from the surface of the conductive member 20 to the developing electrode 5, thus supplying a potential of from 100 volts to several kilovolts to the developing electrode.

The power supply circuit as shown in FIG. 1 comprises a load resistor 11 and a constant voltage element, for example, a varistor or a Zener diode 12, having a threshold value of 100 volts, connected in series with the terminal C and ground. The output terminal E is connected to the junction between the resistor and the Zener diode, and in this manner, a given bias potential of about +100 volts can be maintained at the output terminal E during the discharge operation of the corona discharger 2. The load resistor 11 may be omitted where a discharge resistance is high.

Figure 3:
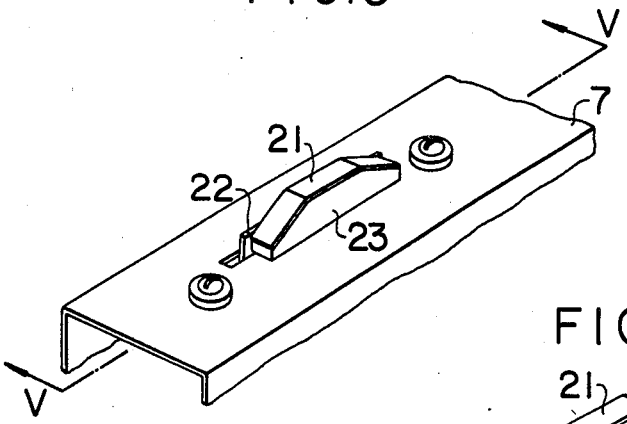
FIG. 3 is a perspective view of a conductive member which is used in the present invention.
Figure 4:
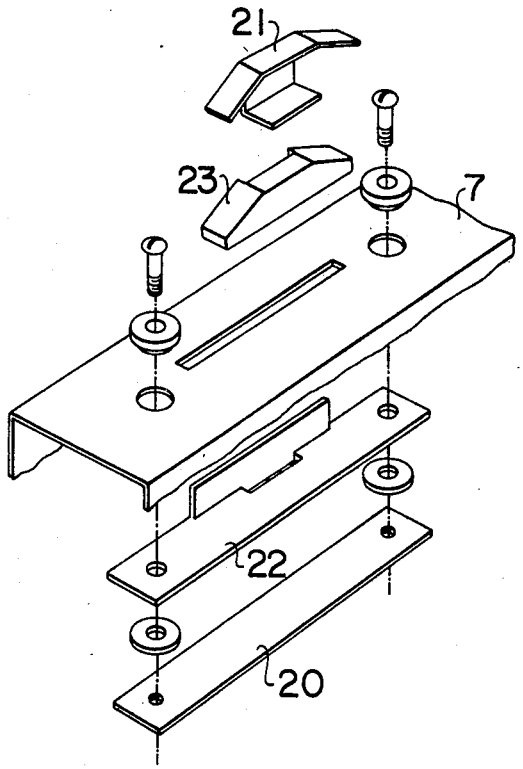
FIG. 4 is an exploded, perspective view of the conductive member.
Figure 5:
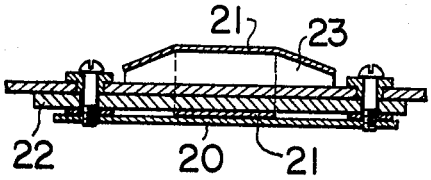
FIG. 5 is a section of the conductive member as taken along the line V—V shown in FIG. 3.

Referring to FIGS. 3, 4 and 5, the conductive member 20 comprises a metal film such as, for example, a foil layer of copper or aluminium or an insulating material formed on the surface thereof with a film of conductive paint, such as that containing silver and carbon powder. The conductive member is threadably secured to an inner wall surface of a shield casing 7 of the corona discharger 2 with an insulating plate 22, such as can be provided by an acryl sheet or Mylar film, interposed between the conductive member and the casing 7 so as to electrically isolate the conductive member from the casing 7. A connection piece 21 which is electrically insulated by an insulating element 23 engages the central portion of the conductive member 20, and forms the terminal for connection with the power supply circuit 10.

Figure 2:
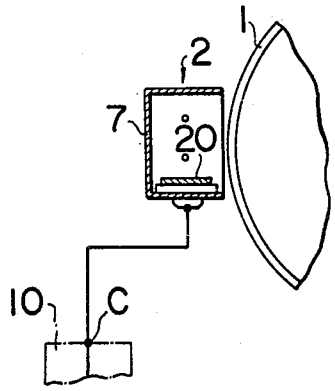
FIG. 2 is a schematic view of a different corona discharger which is constructed in accordance with the present invention.

The size of the conductive member 20 and its position on the casing 7 are not critical. Depending on conditions to be described later, it may be located on the rear surface of the shield casing 7 (see FIG. 1) or may be located on the lateral side thereof (see FIG. 2). Since the magnitude of the current generated is generally proportional to the length of the conductive member 20, its length is determined in accordance with a desired value of the current. By experiments, it was found that by using a conductive member which measures 12 mm×70 mm, a d.c. current of 15 μA was derived when a corona discharger having a discharge voltage of +6.3 kV was employed. In this example, the spacing between the conductive member and the electrode wire was 13 mm, the width of the opening of the casing was 20 mm, and the distance between the electrode wire and the photosensitive member was 9 mm.

What should be considered when determining the mounting location of the conductive member 20 is its influence upon the uniformity of the primary charging by the corona discharger. For this reason, the location cannot be universally stated, but varies with the particular prameters of the corona discharger. It is necessary to test the charging characteristic of the corona discharger when the final location is to be determined. It is to be understood that the configuration of the conductive member 20 is not critical, and may comprise a metal plate, for example. The discharger which is used as a power source therefor may be any discharger other than that used for charging the photosensitive member.

Figure 6:
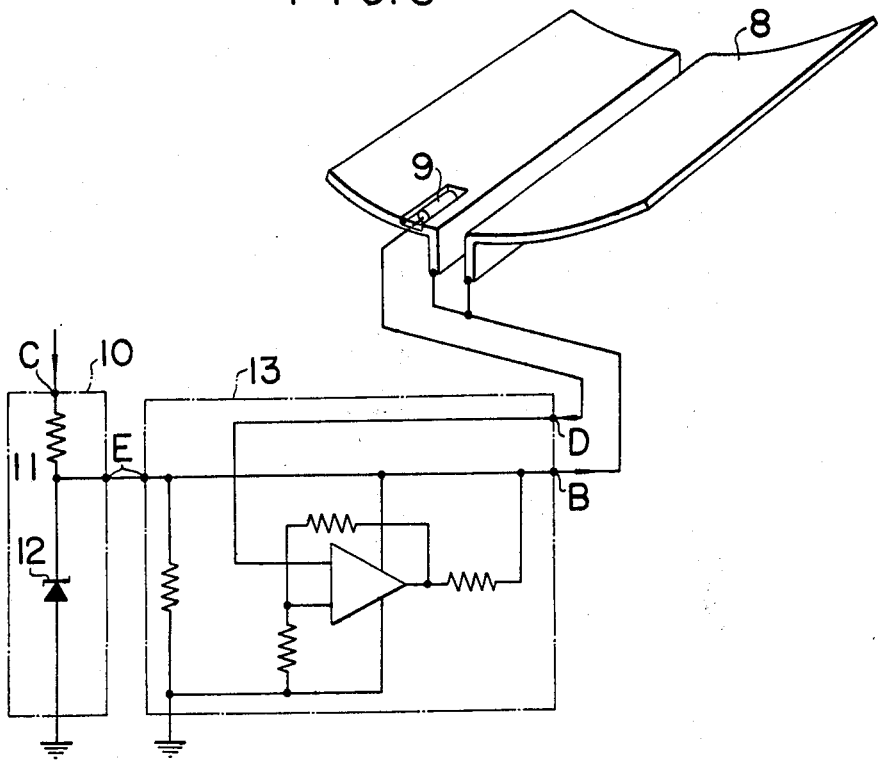
FIG. 6 is a circuit diagram of a power supply circuit and an operational amplifier, illustrating another application of the power supply unit according to the invention.

While an application to the developing unit of constant bias potential type has been described in the above embodiment, the described power supply may be utilized in a number of biasing techniques. By way of example, FIG. 6 shows an application of the present invention to a developing unit of an auto bias type in which the surface potential of the photosensitive member 1 is detected and a corresponding bias voltage is applied to the developing electrode 5. An operational amplifier 13 of a conventional design is connected between the power supply circuit 10 and a developing electrode 8, and has its input terminal connected with the output terminal E of the power supply circuit. The amplifier includes a terminal B which is connected with the electrode 8, and an input terminal D which is connected with a detection electrode 9 which is insulatingly formed on one end of the electrode 8 for detecting the background potential of the image, thereby applying a corresponding bias potential to the electrode 8 in order to assure a developed image of high quality.

Figure 7:
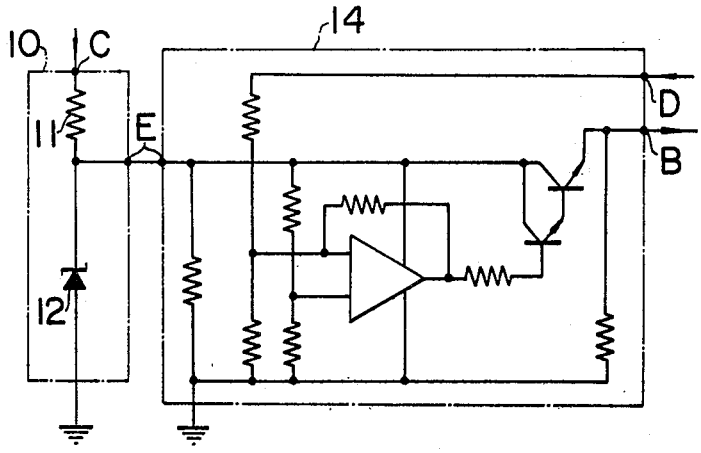
FIG. 7 is a circuit diagram of a different operational amplifier which may be used in the present invention.

A more reliable biasing effect can be achieved by replacing the amplifier 13 by another operational amplifier 14 shown in FIG. 7. Operational amplifier 14 includes circuitry for compensating for any variation in the corona discharge and a corresponding variation in the electromotive force applied to the conductive member 20 so as to maintain the current from the bias supply at a constant value.

Figure 8:
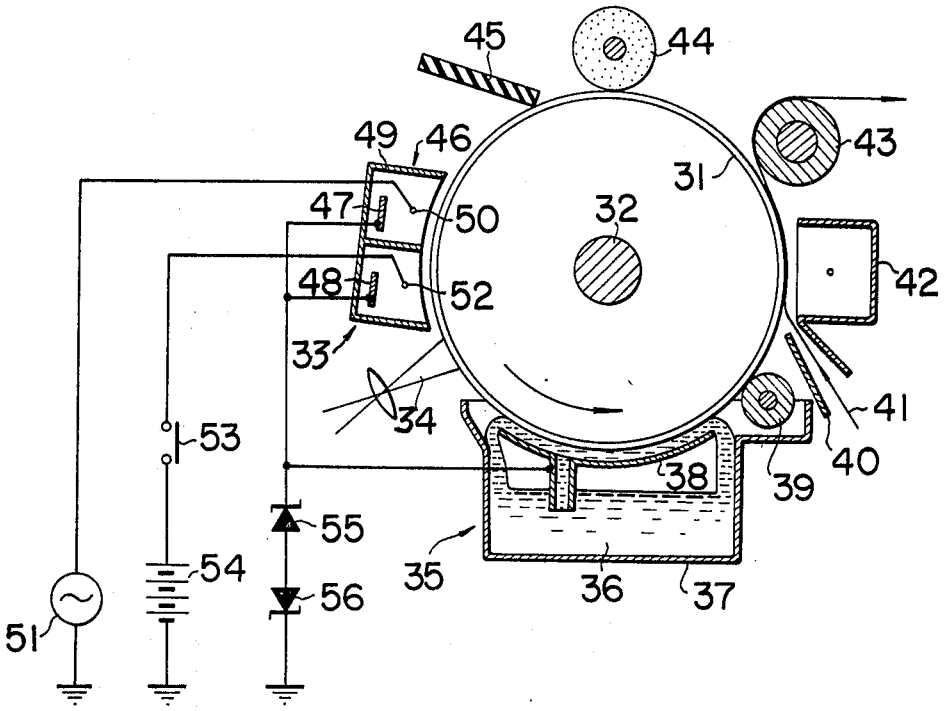
FIG. 8 is a schematic section of an electrophotographic copying machine of the wet type to which the invention is applied.

Several embodiments of the present invention will be described below as applied to an electrophotographic copying machine of a wet type which is provided with a discharger for charge elimination in addition to the primary corona discharger. Referring to FIG. 8, a photosensitive member 31 is provided on its periphery with a layer of photoconductive material, which is selenic in the present example, and is mounted on a shaft 32 for rotation with a uniform speed in the direction indicated by the arrow. A primary corona discharger 33 serves to uniformly charge the surface of the photosensitive member 31 to a polarity which depends on the layer of photoconductive material thereon, which polarity is positive in the present example. After having been charged, the photosensitive member 31 is exposed to an image of a light original through an exposure system 4, thereby forming an electrostatic latent image corresponding to the light image on the photosensitive member. The latent image formed is converted into a visual image by applying a toner thereto which is contained in a developing solution 36 and which, in the present example, is charged to the negative polarity. The developing solution 36 is contained in a reservoir 37 and is pumped up to the upper portion of a developing electrode 38 disposed close to and in conformity with the periphery of the photosensitive member 31. After contact with the latent image, the flooding developing solution 36 is collected in the reservoir 37, thus circulating through the developing unit 35. A squeeze roller 39 is shown for removing any excess amount of developer off the peripheral surface of the photosensitive member 31. A transfer paper 41, which is supplied through a guide assembly 40, is brought into superimposed relationship with a surface area of the photosensitive member carrying the visualized toner image, and a transfer corona discharger 42 applies, to the rear surface of the transfer paper 41, a charge of the same polarity as, but of a greater magnitude than, tht applied to the photosensitive member 31. In this way the toner image is transferred onto the transfer paper 41. The transfer paper 41 having the toner image transferred thereto is discharged by a feed roller 43. Any toner which may remain on the peripheral surface of the photosensitive member 31 is cleaned by a cleaning roller 44 and a cleaning blade 45. After completion of one copying cycle, there remains a slight amount of potential on the surface of the photosensitive member 31, which is eliminated in preparation for the next uniform charging by a discharger 46 which, in the present example, is an a.c. corona discharger.

Each of the a.c. corona discharger 46 and the primary corona discharger 33 comprises an electrode plate 47, 48 insulated from a shield casing 49 common to both corona dischargers. These electrode plates can be formed of a metal film such as a foil of copper, aluminium or the like, or an insulating material on the surface of which a film or conductive paint such as that containing silver or carbon powder is formed. Both of these electrode plates 47, 48 are electrically connected with the developing electrode, and are connected with the ground through a pair of back-to-back Zener diodes 55 and 56. The a.c. corona discharger 46 includes a wire electrode 50 connected to an a.c. source 51, and the primary corona discharger 33 includes a wire electrode 52 connected with a d.c. source 54 through a timing relay 53. In a conventional electrophotographic copying machine, the primary corona discharger is turned off as the projection of a light image of an original onto the present surface of the photosensitive member is terminated. However, in accordance with the invention, the timing relay 53 is adjusted so that the primary corona discharger 33 is turned off only after the latent image formed on the surface of the photosensitive member 31 has passed by the developing electrode 38.

Generally, a selenic photosensitive member which is provided with an electrostatic latent image thereon by projection of a light image of an original having an increased non-image area will have a potential on the order of +50 to +70 volts in the non-image area, so that the potential of the developing electrode must be on the order of +80 to +100 volts in order to avoid the background smearing of the copy as a result of deposition of negatively charged toner to the non-image area. In accordance with the embodiment of the present invention as shown in FIG. 8, the provision of the electrode plates 47 and 48 inside the a.c. corona discharger 46 and the primary corona discharger 33, respectively, so that they supply an individual discharge current to feed the Zener diode 55 permits a constant voltage of $V_1 = +100$ volts to be applied to the developing electrode 38 as a bias potential, thus preventing the background smearing. In the embodiment of the present invention shown in FIG. 8, the potential of the developing electrode is constrained to an average d.c. potential of $V_1 = +100$ volts by superimposition of an a.c. component of nearly 60% from the a.c. corona discharge on the d.c. component from the primary corona discharge, but it is found that little difference is noted in the optical density or image quality as compared with the application of a pure d.c. voltage of +100 volts.

Since the primary corona discharge is timed to be turned off after the latent image has passed by the developing electrode, i.e., subsequent to the developing of the latent image, the developing electrode 38 is supplied only with the a.c. component by the a.c. corona discharge after the developing of the latent image takes place. In particular, when a selenic photosensitive member is used which is charged to the positive polarity, the a.c. corona discharge which is used for the elimination of charge has a negative component primarily, so that the developing electrode 38 will be supplied with a negative a.c. component, which is supplied by the Zener diode 56, producing a constant negative potential of $V_2$. Thus, the developing electrode 38 which is supplied with a positive potential to attract a negatively charged toner during the developing of the latent image is supplied with a negative potential during the time after the developing of the latent image has taken place, thus releasing the toner attracted to the developing electrode and preventing toner deposition thereon and hence the background smearing.

Figure 9:
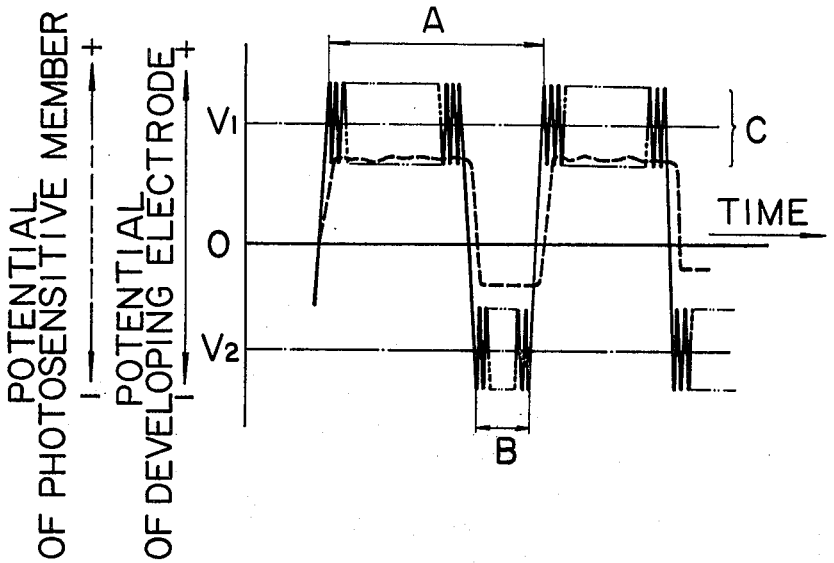
FIG. 9 graphically shows a variation in the potential of the developing electrode of the copying machine shown in FIG. 8.

The above described operation is graphically illustrated in FIG. 9, where the potential of the developing electrode is indicated in a solid line and maintains a constant average positive potential $V_1$ during a period A corresponding when the latent image is being developed during one copying cycle and maintains a constant negative potential $V_2$ during a period B when the developing of the latent image does not take place or when the primary corona discharge is turned off. In this Figure, a superimposed a.c. component is indicated at C. The broken line shows the potential of the photosensitive member 31 under the condition that an image having an increased non-image area is projected thereon. A negative potential on the photosensitive member subsequent to the completion of the developing is caused by triboelectricity which is produced by the cleaning unit to charge the member to the negative polarity as well as by the application of the a.c. discharge which is primarily of the negative polarity, after the primary corona discharge is turned off. In this manner, the photosensitive member 31 is periodically charged to the positive and the negative polarity in an alternate fashion.

Figure 10:
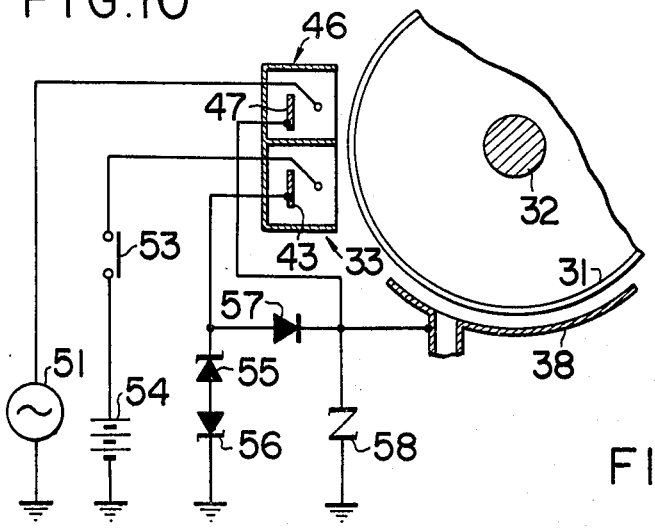
FIG. 10 is a circuit diagram, illustrating another embodiment of the present invention.

FIG. 10 shows another embodiment of the present invention. The embodiment shown in FIG. 10 is adapted for use with a developing process employing a floating electrode which has its potential varied in accordance with that of the latent image, between an upper and a lower limit of the potential. Components which function in a manner similar to those mentioned above are designated by like numerals. Reference numeral 57 represents a rectifier, and 58 an element such as a varistor which maintains a constant voltage in both polarities. With this circuit arrangement, it is necessary to use a small electrode plate 47 which supplies the a.c. component.

While in the embodiments described above, a negative component has been forcedly applied to the developing electrode to remove the toner therefrom, it is found that this is not essential. This is because the deposition of the toner onto the developing electrode is unlikely to occur if the potential is primarily comprised of the a.c. component, even through the average potential remains in the vicinity of zero.

Figure 11:
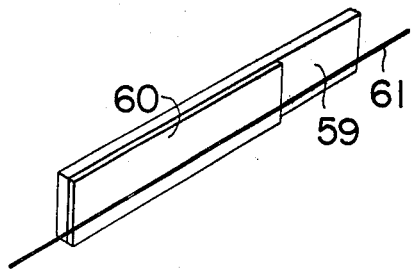
FIG. 11 is a perspective view of an electrode used in one embodiment of the present invention.

FIG. 11 shows an example of the electrode which is adapted to reduce the negative component from the a.c. corona discharger, which primarily produces a negative component, and to increase the pure a.c. component. As in the previous embodiments, the electrode comprises an electrode plate 59 formed of a foil of copper or aluminium on which an insulating film 60 such as a Mylar film is applied so as to expose a portion of the electrode plate 59. A wire electrode is shown at 61. If the insulating film 60 entirely covers the electrode plate 59, a substantially pure a.c. component can be derived.

Figure 12:
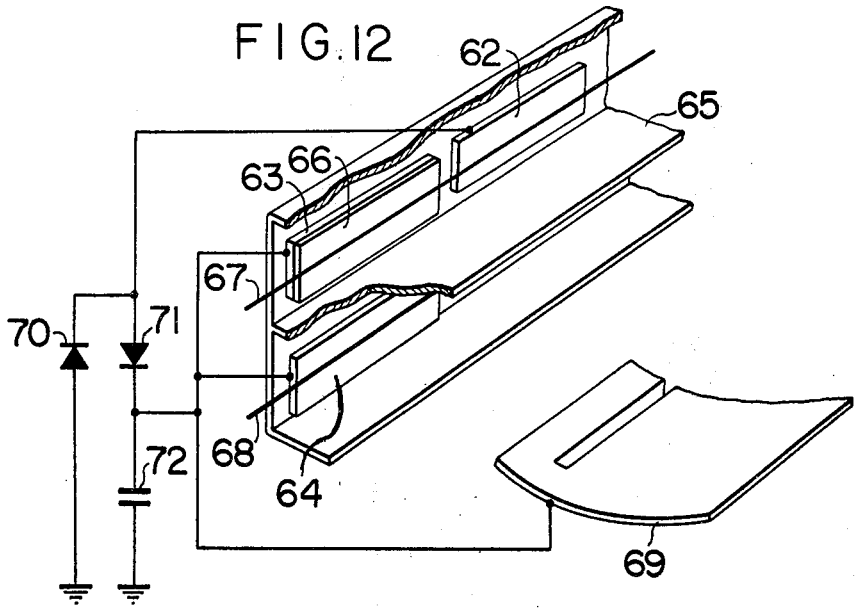
FIG. 12 is a circuit diagram of a further embodiment of the invention.
Figure 13:
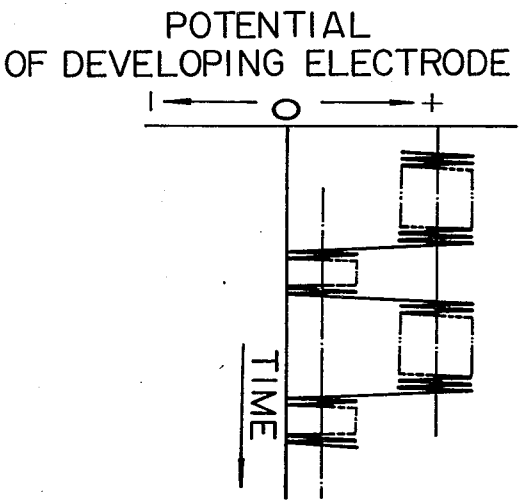
FIG. 13 graphically shows a variation in the potential of the developing electrode in the arrangement of FIG. 12.

FIG. 12 shows a further embodiment of the present invention which derives, from the a.c. corona discharge designed primarily for the negative component, a potential including an a.c. component which is biased to the positive polarity for supply to the developing electrode as a bias potential. A plurality of electrodes 62, 63 and 64 are disposed inside a shield casing 65 and insulated therefrom, and an insulating film 66 is applied to the electrode plate 63. A wire electrode 67 is connected with an a.c. source for producing an a.c. corona discharge. Another wire electrode 68 is connected with a d.c. source through a timing relay for producing the primary corona discharge. The developing electrode is shown at 69. The circuit shown includes a pair of rectifiers 70, 71 and a capacitor 72 having a small capacitance. In this embodiment, the discharge current produced by the a.c. corona discharge is biased to the positive polarity, so that the potential of the developing electrode varies as indicated in FIG. 13.

Figure 14:
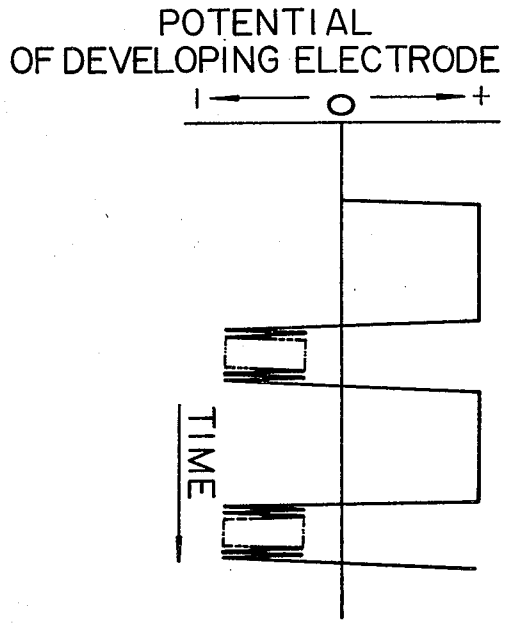
FIG. 14 graphically illustrates a variation in the potential of the developing electrode in still another embodiment of the invention.

It should be understood that a d.c. voltage rather than a voltage including an a.c. component may be applied to the developing electrode during the developing process. To this end, a relay or a pair of switch contacts may be connected in the circuit including the electrode plate 47 and the developing electrode 38, and operated in synchronism with the primary corona discharge in a manner such that a d.c. bias potential can be applied to the developing electrode during the developing process, as indicated in FIG. 14.

From the foregoing description, it will be appreciated that, according to the present invention, the magnitude and the polarity of the bias potential applied to the developing electrode can be chosen so as to avoid the deposition of the toner on the developing electrode, thus assuring that a high quality copy free from the background smearing can to be obtained.

What is claimed is:

1. In a developing unit for use with an electrophotographic copying apparatus of the type comprising a photosensitive member cyclically movable for forming an electrostatic latent image thereon, a developing electrode maintained in opposing relationship with said member, means for supplying a developer between said member and electrode, and a plurality of corona dischargers each having a wire electrode and a shield casing for said wire electrode, the improvement comprising a respective conductive member arranged within each said shield casing in juxtaposed relationship with the wire electrode thereof, and means connecting said conductive members and said developing electrode to conduct charged particles, generated within said corona discharger, from said conductive member to said developing electrode, said plurality of dischargers include a first one for uniformly charging said photosensitive member and a second one using an a.c. voltage source as its power source for removing residual charge therefrom, and the outputs of the respective conductive members associated with the first and second dischargers are superimposed on each other through said connecting means.

2. A unit as in claim 1 wherein said connecting means comprises a rectifier connected between the respective conductive members associated with said first and second dischargers.

3. A unit as in claim 1 wherein the conductive member associated with the second discharger is covered with a film of an insulating material at least in part.

4. In a developing unit for use with an electrophotographic copying apparatus of the type comprising a photosensitive member cyclically movable for forming an electrostatic latent image thereon, a developing electrode maintained in opposing realtionship with said member, means for supplying a developer between said member and electrode and at least one corona discharger having a wire electrode and a shield casing for said wire electrode, the improvement comprising a conductive plate member arranged within said shield casing in juxtaposed relationship with said wire electrode, and means connecting said conductive plate member and said developing electrode to conduct charged particles, generated within said corona discharger, from said conductive plate member to said developing electrode to generate a bias potential on said developing electrode.

5. A unit as in claim 4 wherein said connecting means comprises a constant voltage element connected between said conductive member and the ground, the junction between said conductive member and said element being connected to said developing electrode.

6. A unit as in claim 5 wherein said element comprises at least one Zener diode.

7. A unit as in claim 5 wherein a resistor is connected between said junction and said conductive member.

8. A unit as in claim 4 wherein said conductive member comprises a metal plate insulatedly mounted in said shield casing.

9. A unit as in claim 4 wherein said conductive member comprises a member of an insulating material coated with a conductive material.

10. A unit as in claim 4 wherein plural conductive members are associated with respective ones of a plurality of dischargers used in the apparatus and the outputs of all the conductive members are applied to said developing electrode through said connecting means.

11. Apparatus for developing a latent electrostatic image carried by the surface of a photoconductor having a residual potential in background areas of said image, including means for applying a developer to said surface at a developing station, a development electrode at said station, a constant current source for applying a bias voltage to said development electrode, and means receiving the constant current from said source for applying said bias voltage to said electrode to overcome the effect of said residual potential, said constant current source including a conductive plate member arranged within a shield casing of a corona discharger adapted to supply a charge to said photoconductor.

12. Apparatus as in claim 11 in which the magnitude of said constant current source is such as to raise the potential of said electrode to a potential of a magnitude greater by a predetermined amount than the average potential of said latent image.

13. Apparatus as in claim 11 in which said constant current source produces a bias potential on said electrode of the same polarity as said residual potential, said apparatus including means for applying a reverse bias potential between said electrode and said photoconductor.

14. Apparatus as in claim 13 in which said reverse bias potential applying means comprises a source of potential of a polarity opposite to that of said residual potential and means for applying said opposite polarity potential to said electrode.

15. A process for developing electrostatic latent images formed by an electrophotographic process on a photosensitive member movable cyclically passed a plurality of processing stations including a developing station, the process comprising the steps of maintaining a developing electrode in electrically floating condition in spaced relation to said member to thereby vary the potential of said electrode according to the potential of said image, supplying a developing solution to the space between said electrode and said member, providing a source of voltage to said electrode, and maintaining the potential of said electrode between an upper limit and a lower limit.

16. The process according to claim 15, said voltage being provided by connecting a small plate in a corona discharger to said electrode.

* * * * *